United States Patent [19]

Hoening

[11] 3,994,442

[45] Nov. 30, 1976

[54] SOLID PATTERN MBU BUTTON

[75] Inventor: Kevin James Hoening, Cary, Ill.

[73] Assignee: Seaquist Valve Company, Div. of Pittway Corporation, Cary, Ill.

[22] Filed: Apr. 7, 1975

[21] Appl. No.: 565,686

[52] U.S. Cl. ..... 239/472; 239/492

[51] Int. Cl.[2] ..... B05B 1/34

[58] Field of Search ..... 239/470, 490, 472, 491, 239/492, 473, 475, 579

[56] References Cited

UNITED STATES PATENTS

| | | | |
|---|---|---|---|
| 2,428,748 | 10/1947 | Barz | 239/472 |
| 2,569,081 | 9/1951 | Veach | 239/472 |
| 3,129,893 | 4/1964 | Green | 239/573 X |
| 3,174,692 | 3/1965 | Green | 239/573 X |
| 3,625,437 | 12/1971 | Garrigou | 239/492 X |
| 3,881,658 | 5/1975 | Greenebaum et al. | 239/492 |

*Primary Examiner*—John J. Love
*Attorney, Agent, or Firm*—Stefan M. Stein

[57] ABSTRACT

This invention relates to a valve button structure of the type used with an aerosol container and including a terminal orifice insert mounted within the button in aligned, predetermined relation with a feed post. A plurality of feed passages and at least one central feed channel are disposed in predetermined relation to one another and relative to the feed post so as to concurrently direct fluid product issuing from the aerosol container into a fluid swirl chamber or fluid orienting chamber, through said terminal orifice insert so that the fluid product will exit from the valve body at a relatively high rate and in a predetermined pattern dependent upon the particular product being dispensed from the aerosol container.

8 Claims, 5 Drawing Figures

FIG. 1
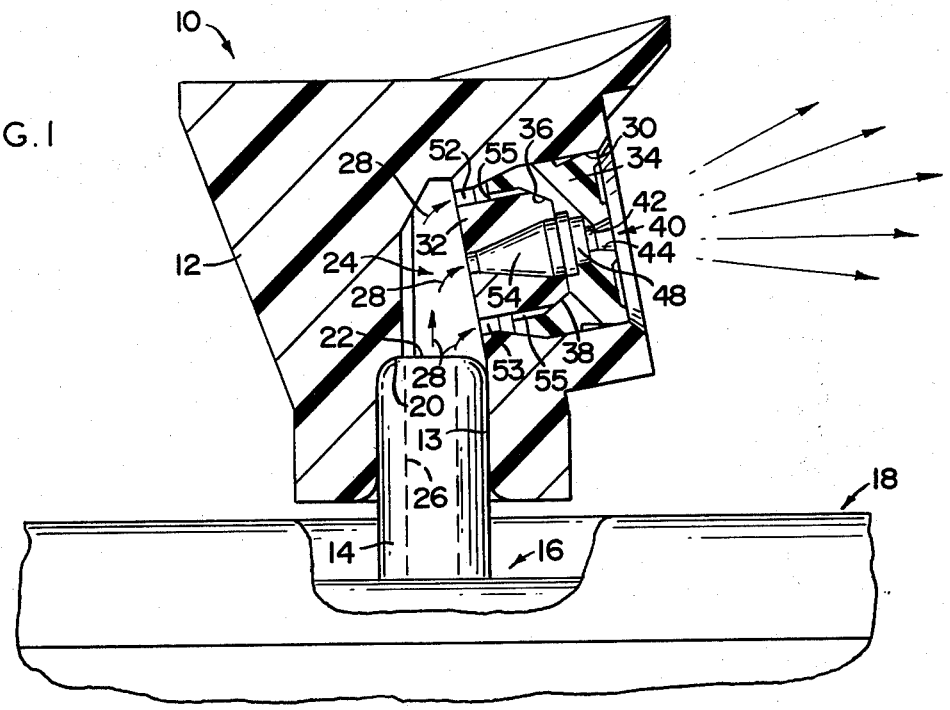
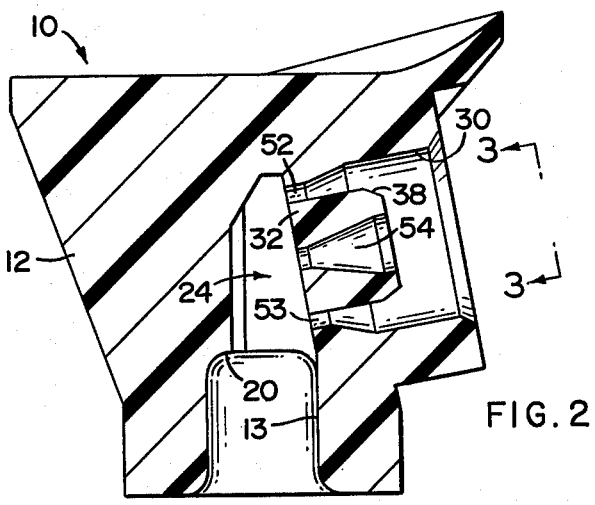
FIG. 2
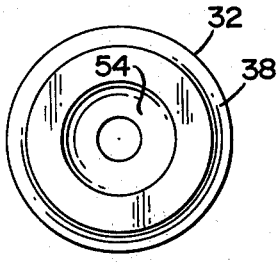
FIG. 3
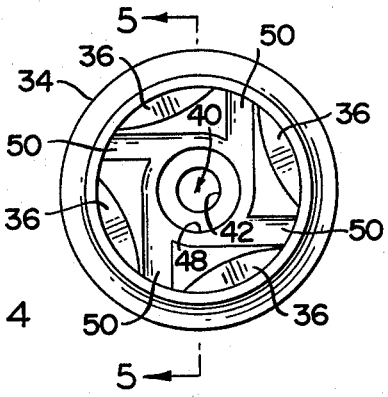
FIG. 4
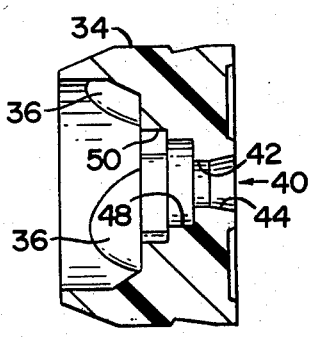
FIG. 5

SOLID PATTERN MBU BUTTON

BACKGROUND OF THE INVENTION

1. Field of the Invention

This invention is directed to a valve button structure including a terminal orifice insert of predetermined design and configuration disposed in communicating relation with one or more feed passages and a feed channel also of predetermined configuration wherein the various structural components of the button are arranged and structured to regulate the rate and/or the pattern of the fluid product as it issues from the body of the valve button dependent upon the particular characteristics of the product being dispensed.

2. Description of the Prior Art

In the aerosol dispensing industry, a constant consideration in the design of the various components which make up an aerosol dispenser, valve mechanism or valve button, is a desired rate and/or pattern of dispensing of product from the container. A major consideration in determining the desired rate or pattern is of course the characteristics of the product being dispensed. It is well known that patterns for dispensing aerosol products range from a light mist-type of pattern to a relatively solid homogeneous pattern for the heavier products.

In order to create the desired pattern, it is well known that certain heavier products must first be mechanically broken-up into a mist-like consistency. The ultimate pattern in which the product is dispensed is then further determined by the configuration of the terminal orifice of the button or of an insert from which the product issues.

There are numerous designs in the aerosol industry for mechanical breakup buttons or actuators for aerosol valves. Generally, such buttons or actuators comprise structures specifically configured to impart a swirling action to the product prior to leaving the terminal orifice. In this manner, the swirling action of the product creates an actual mechanical breakup. The swirling action generated during the breakup of the product normally produces an annular or hollow cone-shaped spray pattern. However, in many instances, and again dependent upon the specific characteristics of the product being dispensed, a more solid or homogeneous spray pattern is desired. However, when dealing with product of a heavier consistency, it is frequently desirable to "break up" the product into more of a mist-like state or consistency so that both the rate of delivery and pattern of the product being dispensed can better be regulated.

Applicant's invention as disclosed and claimed in U.S. Pat. No. 3,785,571 is an example of a mechanical breakup button capable of determining or regulating the pattern of product being dispensed when that product has predetermined characteristics. While the valve button structure of the above-noted patent is extremely satisfactory for the dispensing of certain products, the valve button structure of the present invention represents an improvement thereon wherein product types of certain characteristics are dispensed at predetermined rates and in predetermined patterns.

The French Pat. No. 1,160,064 and the British Pat. No. 1,161,865 also discloses structures relating to aerosol valves and valve buttons utilizing button inserts designed to aid in the determination of the rate and/or product at which products are dispensed. While apparently functional, the valve and valve button structures of these two prior art references show relatively complex structures which are not specifically intended to accomplish regulation of delivery rate and pattern in the manner accomplished by the structure of the present invention.

SUMMARY OF THE INVENTION

This invention relates to a valve button designed to be attached to a valve mechanism for dispensing product from an aerosol container. Connection between the valve button and the valve mechanism can be accomplished by mounting the button on a conventional valve stem associated with the valve mechanism. The button itself includes a feed chamber means communicating with the valve stem and disposed to receive the fluid product issuing therefrom. The valve body further comprises a main orifice formed in one face of the valve body in general communicating relation with the feed chamber means. A feed post means is mounted in the valve body in communicating relation with both the feed chamber means and the main orifice. A terminal orifice insert is positioned within the main orifice of the valve body in aligned relation to the feed post means.

More specifically, feed passage means in the form of a plurality of feed passages are formed, preferably, about the periphery of the feed post means. These feed passages communicate with the feed chamber means and serve to direct product from the feed chamber means to the terminal orifice insert as will be explained in more detail hereinafter.

A central feed channel means in the form of at least one feed channel is located within the feed post means and disposed to extend therethrough. The disposition of the feed channel allows product also to communicate from the feed chamber means to the terminal orifice insert concurrently with the product being directed through the feed passage means to approximately this same pont of the terminal orifice insert.

The terminal orifice insert itself comprises a substantially centrally located fluid orienting chamber, commonly referred to in the art as a swirl chamber. A plurality of insert channels are disposed in chordal relation to the swirl chamber and extend outwardly into communicating relation with the various feed passages. Predetermined alignment between the feed post means and the insert is established such that the central feed channel also communicates directly with the swirl chamber. A preferred embodiment of the present invention comprises the central feed channel having a substantially conical configuration along at least a part of the length thereof and further being disposed in direct, substantially co-axial alignment with the swirl chamber and the terminal orifice of the insert itself.

The configuration of the central feed channel, its disposition relative to the swirl chamber, and the concurrent delivery of fluid product to the swirl chamber both from the central feed channel and from the peripherally located feed passages all are determining factors on both the rate of delivery and of the dispensing pattern as the product issues from the valve button. The specific configuration of the terminal orifice of the insert itself also determines the precise pattern of delivery of the product.

Other structural features of the present invention include the predetermined dimensioning of the insert channels in order to prevent an inordinate amount of back pressure buildup during the dispensing of the product. This is particularly important when a high rate of delivery is desired for a product having the characteristics of relatively large particle size.

While the structure of the present invention is not intended to be limited to the dispensing of any specific product or category of products, it is recognized that the structure of the subject valve button is particularly efficient and applicable for the dispensing of relatively heavier products such as oven cleaners or products of like consistency.

In operation, pressure is exerted on the valve button in a conventional manner. This pressure is transferred to a valve stem which in turn actuates the valve mechanism associated with the aerosol dispenser. The product within the container, due to the existence of the propellant also in the container, is forced up through the interior of the valve stem into the feed chamber means. Due to the disposition of the feed passage means and the cental feed channel, the product is concurrently passed through the feed passages and the central feed channel into the fluid orienting chamber or swirl chamber formed in the terminal orifice insert. More specifically, the plurality of feed passages direct the product through the plurality of insert channels and into the swirl chamber. This creates a swirling effect on the product within the swirl chamber. The product being directed, simultaneously, through the central feed channel is allowed to be forced through the swirling product within the chamber and out through the terminal orifice, along with the other product in the swirl chamber. Dependent upon the specific configuration of the terminal orifice of the insert, the resulting pattern may be substantially round, solid and generally homogeneous. The proper dimensioning of the feed passage means, the central feed channel means and the insert channels also accomplishes a predetermined high delivery rate frequency desirable for a heavier-type product.

This invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a side view in partial section showing the interior of the valve button body of the present invention and the flow of product therethrough.

FIG. 2 is a sectional view of the valve button with terminal orifice insert removed therefrom.

FIG. 3 is a detailed end view of the feed post means taken along line 3—3 of FIG. 2.

FIG. 4 is a detailed view showing the interior of the terminal orifice.

FIG. 5 is a sectional view taken along 5—5 of FIG. 4 showing the interior structure of the terminal orifice insert.

Similar reference characters refer to similar parts throughout the several views of the drawings.

DETAILED DESCRIPTION

As shown in FIGS. 1 and 2, the preferred embodiment of the present invention comprises a valve button generally indicated as 10 including a valve body 12.

The button 10 includes a recess 13 designed to fit on the end of a conventional valve stem 14 which is part of a valve mechanism 16. The valve mechanism 16 serves to actuate the remainder of the aerosol dispenser structure generally indicated as 18. A semi-annular ledge or like stop element 20 is disposed on the interior of the body 12 within recess 13 in abutting relation to terminal end 22 of the valve stem 14. Accordingly, the valve button 10 is properly mounted on the valve stem 14 and in communication with the product on the interior of dispenser 18 as will be explained in greater detail hereinafter. Feed chamber means 24 is disposed in product receiving position relative to the product issuing from the interior channel 26 of valve stem 14. For purposes of clarity, this product is illustrated by directional arrows 28 as shown.

Valve button 10 further comprises a main terminal orifice 30 formed in the interior of the body 12. A feed post means 32 is fixedly mounted within the inner or rear portion (as shown) of the main terminal orifice 30 in direct fluid communication with the feed chamber means 24.

A terminal orifice insert 34 is press-fitted into and frictionally engages the interior of the main orifice 30. The dimension and configuration of the insert 34 is such as to completely cover the opening of the orifice 30 formed in the body 12. As best shown in FIG. 4, a plurality of fillets 36 (usually four, although more or less may be used) are positioned to engage lands 38 of feed post 32. This engagement serves to align insert 34 with post 32 in a predetermined relationship with one another.

As best shown in FIGS. 4 and 5, the insert further comprises a terminal orifice generally indicated as 40 and including an inner portion 42 of lesser diameter and an outer portion 44 of greater diameter. Portion 44 may also be configured to have an outward flare or somewhat conical configuration along its length as shown in FIG. 5. A fluid orienting chamber or swirl chamber 48 is centrally located on the interior of insert 34 and communicates with a plurality of insert channels 50 disposed in chordal relation to the swirl chamber 48 as shown.

With reference to FIGS. 1, 2 and 3, feed passage means comprises one or more feed passages 52 and 53 disposed in communicating relation with the feed chamber means 24. Feed passages 52 and 53 are disposed substantially about the periphery of feed post 32. A central feed channel means 54, preferably comprising a single centrally located feed channel, is also in direct communication with the feed chamber means 24. Both the feed passages 52 and 53 and the centrally located feed channel are disposed to direct product from the feed chamber means 24 to the swirl chamber 48. More specifically, upon the insertion of terminal orifice insert 34, an annular directing channel 55 is disposed in connecting relation with both of the feed passages 52 and 53. This annular passage 55 is also in direct communication with the plurality of insert channels 50. Accordingly, fluid from the feed chamber 28 is directed through feed passages 52 and 53, into annular passage 55 and through the insert channels 50 to the substantially centrally located swirl chamber 48. Due to the disposition of the central feed channel 54, fluid product is directed therethrough, simultaneously to the product being directed through the feed passages 52 and 53. From the central feed channel 54, the product 28 passes into and through the swirl chamber 38. At this point fluid product from channel 54 passes through and mixes with the swirling product entering the swirl chamber 48 from the insert channels 50 wherein the combined product passes through terminal orifice 40 in the conventional manner.

Other structural features of the present invention comprise the configuration of central channel 54 including a substantially conical shape at least along a portion of its length as shown in FIGS. 1 and 2. More specifically, central channel 54 may include a configuration defined by a gradually increasing diameter along its length as it extends from the feed chamber means 28 to the swirl chamber or fluid orienting chamber 48.

It will thus be seen that the objects set forth above, among those made apparent from the preceding description, are efficiently attained and, since certain changes may be made in the above description without departing from the scope of the invention it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language might be said to fall therebetween.

Now that the invention has been described,

What is claimed is:

1. A valve button for an aerosol container to be used in combination with a terminal orifice insert, said valve button comprising: a main terminal orifice formed in the body of said valve button, feed chamber means formed within said body and disposed in fluid communication with the interior of the aerosol container, feed post means mounted to said body of said valve button and in fluid communicating relation to said feed chamber means, said terminal orifice insert itself including a terminal orifice, said terminal orifice insert disposed within said main terminal orifice of said valve body in predetermined aligned relation with said feed post means; feed passage means disposed at least in part between said feed chamber means and said terminal orifice insert, said feed passage means comprising a plurality of feed passages disposed substantially adjacent the outer periphery of said feed post means and in interconnecting fluid relation between said feed chamber means and said terminal orifice insert; said feed post means comprising central feed channel means including one feed channel formed within said feed post means in substantially coaxially aligned relation to said terminal orifice and extending through said feed post means and further being disposed in direct fluid communication with said terminal means, said central feed channel means including a varying diameter along at least a portion of the length of said central feed channel means; said terminal orifice including a varying diameter along at least a portion of the length of said terminal orifice, the maximum diameter of said central feed channel means being larger than the maximum diameter of said terminal orifice, whereby fluid product from the aerosol container passes from said feed chamber means concurrently through both said plurality of feed passages and said one feed channel to said terminal orifice insert and subsequently to the exterior of the valve button in a predetermined pattern.

2. A valve button as in claim 1 wherein said central feed channel means comprises a substantially conical configuration along at least a portion of the length thereof.

3. A valve button as in claim 2 wherein said central feed channel means is configured to include a gradually increasing diameter along at least a portion of its length extending from said feed chamber means to said terminal orifice insert.

4. A valve button as in claim 1 wherein said terminal orifice insert comprises a fluid orienting chamber formed therein and disposed in fluid communicating relation with said feed post means, said feed passage means disposed in interconnecting relation between said feed chamber means and said fluid orienting chamber.

5. A valve button as in claim 4 wherein said central feed channel means is disposed in interconnecting relation between said feed chamber means and said fluid orienting chamber, whereby fluid product from the aerosol container is simultaneously directed through said feed passage means and said central feed channel means to said terminal orifice insert.

6. A valve button as in claim 1 wherein said terminal orifice insert comprises a fluid orienting chamber positioned adjacent said feed post means and in fluid communication with said plurality of feed passages and said one feed channel, whereby fluid product is concurrently directed from said feed channel means to said fluid orienting chamber through said feed passage means and said central feed channel means.

7. A valve button as in claim 6 wherein said terminal orifice insert is disposed in aligned relation with said feed post means; said terminal orifice of said insert positioned in substantially co-axially position with said one feed channel, said fluid orienting chamber disposed between and in communicating relation with both said terminal orifice of said insert and said one feed channel.

8. A valve button as in claim 7 wherein said terminal orifice insert comprises a plurality of insert channels positioned in chordal relation to said fluid orienting chamber, said plurality of insert channels disposed in fluid communicating relation between said fluid orienting chamber and said fluid passage means, whereby fluid product is directed into said fluid orienting chamber and from said fluid passage means through said insert channel concurrently with fluid from said central feed channel means.

* * * * *

UNITED STATES PATENT OFFICE

CERTIFICATE OF CORRECTION

Patent No. 3,994,442 Dated November 30, 1976

Inventor(s) Kevin James Hoening

It is certified that error appears in the above-identified patent and that said Letters Patent are hereby corrected as shown below:

Column 2, line 39, "pont" should read --- point ---.

Column 6, line 36 "feed channel" should read ---- feed chamber ----.

Column 6, line 54, delete "and".

Signed and Sealed this

Twelfth Day of April 1977

[SEAL]

*Attest:*

RUTH C. MASON
*Attesting Officer*

C. MARSHALL DANN
*Commissioner of Patents and Trademarks*